US007648597B2

(12) United States Patent
Nagao et al.

(10) Patent No.: US 7,648,597 B2
(45) Date of Patent: Jan. 19, 2010

(54) METHOD FOR MANUFACTURING HIGH TENSILE STRENGTH STEEL PLATE

(75) Inventors: Akihide Nagao, Hiroshima (JP); Kenji Oi, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 383 days.

(21) Appl. No.: 10/585,548

(22) PCT Filed: Jul. 6, 2005

(86) PCT No.: PCT/JP2005/012884

§ 371 (c)(1),
(2), (4) Date: Jul. 10, 2006

(87) PCT Pub. No.: WO2006/004228

PCT Pub. Date: Jan. 12, 2006

(65) Prior Publication Data

US 2008/0283158 A1 Nov. 20, 2008

(30) Foreign Application Priority Data

Jul. 7, 2004 (JP) ..... 2004-200514

(51) Int. Cl.
*C21D 8/02* (2006.01)

(52) U.S. Cl. ..... 148/547; 148/654; 148/663

(58) Field of Classification Search ..... 148/547, 148/663, 320, 330–336
See application file for complete search history.

(56) References Cited

FOREIGN PATENT DOCUMENTS

| | | | |
|---|---|---|---|
| JP | 55-49131 | B2 | 12/1980 |
| JP | 59-232234 | A | 12/1984 |
| JP | 62-93312 | A | 4/1987 |
| JP | 3-68715 | A | 3/1991 |

(Continued)

OTHER PUBLICATIONS

English abstract of Japanese patent 358104120, Kunhiko Kobayashi et al., Jun. 21, 1983.*

(Continued)

*Primary Examiner*—Deborah Yee
(74) *Attorney, Agent, or Firm*—Frishauf, Holtz, Goodman & Chick, P.C.

(57) ABSTRACT

The present invention provides a method for manufacturing high tensile strength steel plate having 570 MPa (N/mm$^2$) or larger tensile strength and having also extremely superior balance of strength and toughness both before PWHT and after PWHT to that of the conventional steel plates, by specifically specifying the temperature-rising rate at the plate thickness center portion of a quenched and tempered material during tempering, and to be concrete, the method has the steps of: casting a steel consisting essentially of 0.02 to 0.18% C, 0.05 to 0.5% Si, 0.5 to 2.0% Mn, 0.005 to 0.1% Al, 0.0005 to 0.008% N, 0.03% or less P, 0.03% or less S, by mass, and balance of Fe and inevitable impurities; hot-rolling the cast steel without cooling the steel to the $Ar_3$ transformation point or lower temperature, or after reheating the steel to the $Ac_3$ transformation point or higher temperature, to a specified plate thickness; cooling the steel by direct quenching from the $Ar_3$ transformation point or higher temperature, or by accelerated cooling, to 400° C. or lower temperature; and then tempering the steel, using a heating apparatus being installed directly connecting the manufacturing line containing a rolling mill and a direct-quenching apparatus or an accelerated cooling apparatus, to 520° C. or above of the maximum ultimate temperature at the plate thickness center portion at an average temperature-rising rate of 1° C./s or larger at the plate thickness center portion up to a specified tempering temperature between 460° C. and the $Ac_1$ transformation point.

8 Claims, 1 Drawing Sheet

FOREIGN PATENT DOCUMENTS

| | | | |
|---|---|---|---|
| JP | 4-297547 | A | 10/1992 |
| JP | 4-358022 | A | 12/1992 |
| JP | 4-358023 | A | 12/1992 |
| JP | 9-256037 | A | 9/1997 |
| JP | 9-256038 | A | 9/1997 |
| JP | 10-96042 | A | 4/1998 |
| JP | 2002-241837 | * | 8/2002 |
| JP | 2005-232562 | A | 9/2005 |

OTHER PUBLICATIONS

English abstract of Japanese patent 358153730, Nozomi Komatsubara et al, Sep. 12, 1983.*

* cited by examiner

METHOD FOR MANUFACTURING HIGH TENSILE STRENGTH STEEL PLATE

This application is the United States national phase application of International Application PCT/JP2005/012884 filed Jul. 6, 2005.

TECHNICAL FIELD

The present invention relates to a method for manufacturing high tensile strength steel plate which has an excellent balance of strength and toughness of quenched and tempered material, (giving high strength and high toughness: the excellent balance of strength and toughness is defined as that the plots on a graph of strength in the horizontal axis and fracture surface transition temperature in the vertical axis shift from three o'clock to six o'clock), and specifically relates to a method for manufacturing high tensile strength steel plate which is subjected to stress relief annealing after welding, (hereinafter referred to as "post welded heat treatment (PWHT)), and to a method for manufacturing high tensile strength steel plate having superior balance of strength and toughness both before PWHT and after PWHT to conventional materials by specifying the temperature-rising rate at the plate thickness center portion of the quenched and tempered plate during tempering.

BACKGROUND ART

In recent years, the development of steel stronger than ever is wanted to fulfill the requirements of scale-up of steel structures such as marine structures and of reduction in line pipe laying cost. Since the steels having about 570 MPa ($N/mm^2$) or larger tensile strength induce martensitic or bainitic transformation resulting from quenching, thus giving poor toughness of as-quenched steels, they are often improved mainly in the toughness before practical applications by applying succeeding tempering treatment to precipitate carbide from super-saturation solid solution carbon.

That type of quenched and tempered steel plates is conventionally manufactured by directly quenching after rolling, followed by tempering, as disclosed in, for example, JP-B-55-49131, (the term "JP-B" referred to herein signifies the "Examined Japanese Patent Publication").

The process of tempering in the disclosed technology, however, takes a long time for heating the steel plate and holding the temperature thereof so that the tempering has to be given in a separate line from the quenching manufacturing line. As a result, the transfer of the steel plate to the separate line takes unnecessary time in view of metallurgy. Therefore, the disclosed technology needs an improvement from the point of productivity and manufacturing cost.

To solve the above problems, Japanese Patent No. 3015923, Japanese Patent No. 3015924, and the like disclose methods for manufacturing high strength steel that allows tempering thereof in the same manufacturing line of quenching owing to the achieved rapid and short time of tempering, that significantly increases the productivity of quenched and tempered steel plate, thus improving the productivity and the manufacturing cost, and that provides a steel plate tougher than conventional quenched and tempered steel plate also in view of material.

The material which is rapidly tempered in a short time, disclosed in the above Japanese Patent No. 3015923 and Japanese Patent No. 3015924, however, have a drawback of being unable to respond to a severe toughness requirement in a cold district. Accordingly, a method for manufacturing further tough high strength steel was desired.

Furthermore, high tensile strength steels used as tanks, penstocks, and the like often achieve the prevention of occurrence of deformation and brittle fracture of structures by applying PWHT after the welding which is given on fabricating the structures, thereby conducting relief of the residual stress, softening of the weld-hardened part, and desorption of hydrogen in the weld-hardened part.

Increase in the size of steel structures such as tanks and penstocks is a trend in recent years, thus the need of increased strength and thickness of steels increases. Increase in the strength and the thickness of steels, however, also raises severe PWHT conditions of higher temperature and longer time, thereby often inducing decrease in strength and toughness after the treatment.

To cope with these problems, JP-A-59-232234, (the term "JP-A" referred to herein signifies the "Unexamined Japanese Patent Publication"), JP-A-62-93312, JP-B-9-256037, JP-B-9-256038, and the like disclose methods for manufacturing steel plate having excellent strength and toughness after PWHT, by optimizing alloying elements, applying work-heating treatment technology, or utilizing heat treatment before PWHT.

The methods disclosed in JP-A-59-232234, JP-A-62-93312, JP-B-9-256037, JP-B-9-256038, and the like have, however, a problem that the steel cannot respond to the severe request of strength and toughness characteristics after PWHT, which request is given for the case of cold-district services, and the like. Therefore, there has been a desire for a method of manufacturing high tensile strength steel plate that has superior balance of strength and toughness after PWHT to that of conventional steel plates.

DISCLOSURE OF THE INVENTION

To solve the above problems of the related art, the present invention provides a method for manufacturing high tensile strength steel plate having extremely superior balance of strength and toughness both before PWHT and after PWHT to that of the conventional steel plates, by specifically specifying the temperature-rising rate at the plate thickness center portion of a quenched and tempered material during tempering, thus precipitating cementite in finely dispersed state, thereby suppressing agglomeration and coarsening of cementite during heat treatment, which cementite becomes main cause of deterioration of strength and toughness balance both before PWHT and after PWHT. The essence of the present invention is the following.

1. The method for manufacturing high tensile strength steel plate has the steps of: casting a steel consisting essentially of 0.02 to 0.18% C, 0.05 to 0.5% Si, 0.5 to 2.0% Mn, 0.005 to 0.1% Al, 0.0005 to 0.008% N, 0.03% or less P, 0.03% or less S, by mass, and balance of Fe and inevitable impurities; hot-rolling the cast steel without cooling the steel to the $Ar_3$ transformation point or lower temperature, or after reheating the steel to the $Ac_3$ transformation point or higher temperature, to a specified plate thickness; cooling the steel by direct quenching from the $Ar_3$ transformation point or higher temperature, or by accelerated cooling, to 400° C. or lower temperature; and then tempering the steel, using a heating apparatus being installed directly connecting the manufacturing line containing a rolling mill and a direct-quenching apparatus or an accelerated cooling apparatus, to 520° C. or above of the maximum ultimate temperature at the plate thickness center portion at an average temperature-rising rate of 1° C. Is or larger at the plate thickness center portion up to a specified tempering temperature between 460° C. and the $Ac_1$ transformation point.

2. The method for manufacturing high tensile strength steel plate has the steps of: casting a steel consisting essentially of 0.02 to 0.18% C, 0.05 to 0.5% Si, 0.5 to 2.0% Mn, 0.005 to 0.1% Al, 0.0005 to 0.008% N, 0.03% or less P, 0.03% or less S, by mass, and balance of Fe and inevitable impurities; hot-rolling the cast steel without cooling the steel to $Ar_3$ transformation point or lower temperature, or after reheating the steel to $Ac_3$ transformation point or higher temperature, to a specified plate thickness; cooling the steel by direct quenching from the $Ar_3$ transformation point or higher temperature, or by accelerated cooling, to 400° C. or lower temperature; and then tempering the steel, using a heating apparatus being installed directly connecting the manufacturing line containing a rolling mill and a direct-quenching apparatus or an accelerated cooling apparatus, to 520° C. or above of the maximum ultimate temperature at the plate thickness center portion at an average temperature-rising rate of smaller than 1° C. Is at the plate thickness center portion between the tempering-start temperature and 460° C., and at an average temperature-rising rate of 1° C. Is or larger at the plate thickness center portion up to a specified tempering temperature between 460° C. and the $Ac_1$ transformation point.

3. Regarding the method for manufacturing high tensile strength steel plate according to above 1 or 2, the steel further contains one or more of 2% or less Cu, 4% or less Ni, 2% or less Cr, and 1% or less Mo, by mass.

4. Regarding the method for manufacturing high tensile strength steel plate according to any of above 1 to 3, the steel further contains one or more of 0.05% or less Nb, 0.5% or less V, and 0.03% or less Ti, by mass.

5. Regarding the method for manufacturing high tensile strength steel plate according to any of above 1 to 4, the steel further contains one or more of 0.003% or less B, 0.01% or less Ca, 0.02% or less REM, and 0.01% or less Mg, by mass.

6. The steel plate manufactured by the manufacturing method according to any of above 1 to 5 is a high tensile strength steel plate for stress relief annealing.

EMBODIMENTS OF THE INVENTION

Figure 1:
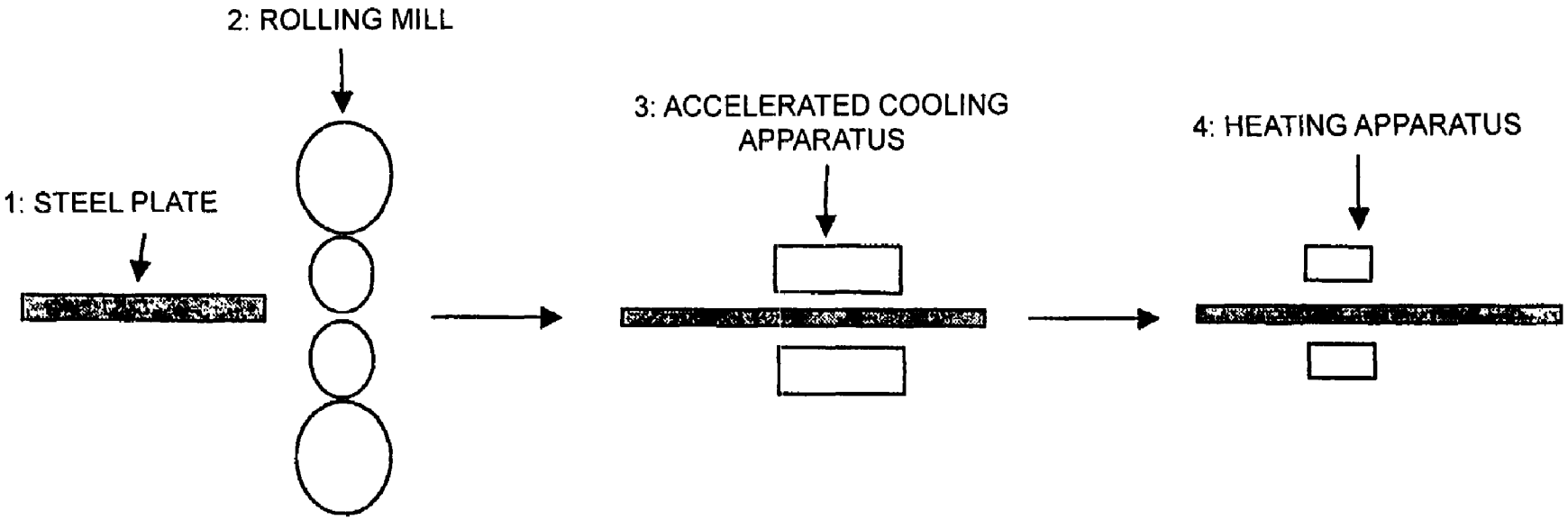
FIG. 1 shows an example of the rolling apparatus and the heat treatment apparatus according to the present invention.

To solve the above problems in the related art, the present invention provides a method for manufacturing high tensile strength steel plate having extremely superior balance of strength and toughness both before PWHT and after PWHT to that of the conventional steel plates, by specifically specifying the temperature-rising rate at the plate thickness center portion of a quenched and tempered material during tempering, thus precipitating cementite in finely dispersed state, thereby suppressing agglomeration and coarsening of cementite caused by PWHT, which cementite becomes main cause of deterioration of strength and toughness both before PWHT and after PWHT.

The reasons to limit the individual ingredients according to the present invention are described below. The percentage (%) signifying the content of each chemical ingredient in the composition is mass percentage.

(C: 0.02 to 0.18%)

Carbon is Added to Secure the Strength. If, However, the C content is less than 0.02%, the effect becomes insufficient. On the other hand, if the C content exceeds 0.18%, the toughness of base material and of welded-heat affected zone deteriorates, and the weldability significantly deteriorates. Therefore, the C content is specified to a range from 0.02 to 0.18%. A more preferable range is from 0.03 to 0.17%.

(Si: 0.05 to 0.5%)

Silicon is added as a deoxidizer and to increase the strength during the steel making stage. If, however, the Si content is less than 0.05%, the effect becomes insufficient. On the other hand, if the Si content exceeds 0.5%, suppression of the cementite generation appears, thus, even at the tempering temperature of 520° C. or above, satisfactory fine and dispersed precipitation of cementite cannot be attained, thereby deteriorating the toughness at the base material and the welded-heat affected zone both before PWHT and after PWHT. Consequently, the Si content is specified to a range from 0.05 to 0.5%. A more preferable range is from 0.1 to 0.45%.

(Mn: 0.5 to 2.0%)

Manganese is added to secure the strength. If, however, the Mn content is less than 0.5%, the effect becomes insufficient. On the other hand, if the Mn content exceeds 2.0%, the toughness at the welded-heat affected zone deteriorates and the weldability significantly deteriorates. Accordingly, the Mn content is specified to a range from 0.5 to 2.0%. A more preferable range is from 0.9 to 1.7%.

(Al: 0.005 to 0.1%)

Aluminum is added as a deoxidizer, and has an effect of refinement of grains. If, however, the Al content is less than 0.005%, the effect becomes insufficient. On the other hand, if the Al content exceeds 0.1%, surface flaws on the steel plate likely appear. Consequently, the Al content is specified to a range from 0.005 to 0.1%. A more preferable range is from 0.01 to 0.04%.

(N: 0.0005 to 0.008%)

Nitrogen is Added to Attain the Effect of Refining the structure by forming nitride with Ti and the like, thus increasing the toughness at the base material and the welded-heat affected zone. If, however, the N content is less than 0.0005%, the effect of refinement of structure cannot be fully attained. On the other hand, if the N content exceeds 0.008%, the quantity of solid solution of N increases to deteriorate the toughness at the base material and the welded-heat affected zone. Therefore, the N content is specified to a range from 0.0005 to 0.008%. A more preferable range is from 0.001 to 0.006%.

(P: 0.03% or less, S: 0.03% or less)

Both P and S are impurities. If any of P and S exceeds 0.03%, non-defective base material and welded joint cannot be obtained. Accordingly, the P content and the S content are specified to 0.03% or less, respectively. A more preferable range is from 0.02% or less P and 0.006% or less S.

According to the present invention, the following ingredients may further be added depending on the desired characteristics.

(Cu: 2% or less)

Copper functions to increase the strength through the solid solution strengthening and the precipitation strengthening. To attain the effect, the Cu content of 0.05% or more is preferred. If, however, the Cu content exceeds 2%, hot-cracking likely appears during slab heating stage and welding stage. Consequently, when Cu is added, the Cu content is specified to 2% or less. A more preferable range is from 0.1 to 1.8%.

(Ni: 4% or less)

Nickel functions to increase the toughness and the hardenability. To attain the effect, the Ni content of 0.1% or more is preferred. If, however, the Ni content exceeds 4%, the economy deteriorates. Consequently, when Ni is added, the Ni content is specified to 4% or less. A more preferable range is from 0.2 to 3.5%.

(Cr: 2% or less)

Chromium functions to increase the strength and the toughness, and has excellent high temperature strength characteristics. To attain the effect, the Cr content of 0.1% or more is preferred. If, however, the Cr content exceeds 2%, the weldability deteriorates. Consequently, when Cr is added, the Cr content is specified to 2% or less. A more preferable range is from 0.2 to 1.8%.

(Mo: 1% or less)

Molybdenum functions to increase the hardenability and the strength, and has excellent high temperature strength characteristic. To attain the effect, the Mo content of 0.05% or more is preferred. If, however, the Mo content exceeds 1%, the economy deteriorates. Consequently, when Mo is added, the Mo content is specified to 1% or less. A more preferable range is from 0.1 to 0.9%.

(Nb: 0.05% or less)

Niobium is added to increase the strength as a micro-alloying element. To attain the effect, the Nb content of 0.005% or more is preferred. If, however, the Nb content exceeds 0.05%, the toughness at the welded-heat affected zone deteriorates. Consequently, when Nb is added, the Nb content is specified to 0.05% or less. A more preferable range is from 0.01 to 0.04%.

(V: 0.5% or less)

Vanadium is added to increase the strength as a micro-alloying element. To attain the effect, the V content of 0.01% or more is preferred. If, however, the V content exceeds 0.5%, the toughness at the welded-heat affected zone deteriorates. Consequently, when V is added, the V content is specified to 0.5% or less. A more preferable range is from 0.02 to 0.4%.

(Ti: 0.03% or less)

Titanium forms TiN during rolling and heating stage or during welding stage, thus suppressing the growth of austenitic grains, and improving the toughness at the base material and the welded-heat affected zone. To attain the effect, the Ti content of 0.001% or more is preferred. If, however, the Ti content exceeds 0.03%, the toughness at the welded-heat affected zone deteriorates. Therefore, when Ti is added, the Ti content is specified to 0.03% or less. A more preferable range is from 0.002 to 0.025%.

(B: 0.003% or less)

Boron functions to improve the hardenability. To attain the effect, the B content of 0.0001% or more is preferred. If, however, the B content exceeds 0.003%, the toughness deteriorates. Therefore, when B is added, the B content is specified to 0.003% or less. A more preferable range is from 0.0002 to 0.0025%.

(Ca: 0.01% or less)

Calcium is an essential element to perform configuration control of sulfide type inclusions. To attain the effect, the Ca content of 0.0005% or more is preferred. If, however, the Ca content exceeds 0.01%, the cleanliness deteriorates. Therefore, when Ca is added, the Ca content is specified to 0.01% or less. A more preferable range is from 0.001 to 0.009%.

(REM: 0.02% or less)

Rare Earth Metal (Rem) Improves the Anti-SR Cracking characteristic by forming sulfide as REM (O, S) in the steel, thus decreasing the quantity of solid solution S at grain boundaries. To attain the effect, the REM content of 0.001% or more is preferred. If, however, the REM content exceeds 0.02%, the cleanliness deteriorates. Therefore, when REM is added, the REM content is specified to 0.02% or less. Amore preferable range is from 0.002 to 0.019%.

(Mg: 0.01% or less)

Magnesium may be used as a desulfurization agent for hot metal. To attain the effect, the Mn content of 0.0005% or more is preferred. If, however, the Mn content exceeds 0.01%, the cleanliness deteriorates. Therefore, when Mn is added, the Mn content is specified to 0.01% or less. A more preferable range is from 0.001 to 0.009%.

The following is the description about a preferred structure according to the present invention.

If the tensile strength is 570 MPa ($N/mm^2$) or larger and smaller than 780 MPa ($N/mm^2$), the structure of the base material according to the present invention is preferably composed of 50% by volume or more of bainite and balance of mainly martensite. If the tensile strength is 780 MPa ($N/mm^2$) or larger, the structure of the base material according to the present invention is preferably composed of 50% by volume or more of martensite and balance of mainly bainite. The determination of the volume percentage of bainite and of martensite in the structure was given by the following procedure. A test piece for observing the metal structure was cut from the prepared steel plate. Cross section of the test piece cut in parallel to the rolling direction was etched with an appropriate reagent. The microstructure of the etched section was observed by a light-microscope at 200 magnification. Five visual fields for each section were photographed to determine the structure. Furthermore, an image analyzer was used to determine the area percentage of bainite and of martensite. Then, an average of the determined area percentages for five visual fields was adopted as the volume percentage of bainite and of martensite in the structure.

The present invention has a characteristic of fine and dispersed precipitation of cementite resulting from rapid heating and tempering. If, however, the mean grain size of cementite exceeds 70 nm, the balance of strength and toughness deteriorates, thus the mean grain size of cementite is preferably 70 nm or smaller, and more preferably 65 nm or smaller. Furthermore, the number of cementite grains having larger than 350 nm in size is preferably three or less within a visual field of 5000 nm square, and more preferably two or less.

The observation of cementite is performed, for example, by using a sample of thin film or extracted replica with a transmission electron microscope. The grain size is evaluated by image analysis in terms of equivalent circle diameter. For the mean grain size, all the cementite grains in the arbitrarily selected five or more of visual fields of 5000 nm square are observed to determine their grain sizes, and their simple average is adopted as the mean grain size.

The reasons to limit the manufacturing conditions according to the present invention are described below.

(Casting Condition)

Since the present invention is also effective to steels manufactured under any casting condition, the casting condition is not necessarily limited.

(Hot-Rolling Condition)

For a cast slab, hot-rolling may begin without cooling thereof to the $Ar_3$ transformation point or lower temperature, or hot-rolling may begin after reheating the once-cooled cast slab to the $Ac_3$ transformation point or higher temperature. The reason of applicability of both hot-rolling conditions is that the effectiveness of the present invention is not deteriorated if only the rolling begins in that temperature range. According to the present invention, if the rolling is completed at the $Ar_3$ transformation point or higher temperature, other rolling conditions are not specifically limited because the effectiveness of the present invention is attained if only the rolling is conducted at temperatures of the $Ar_3$ transformation point or above even when the rolling is given either in the recrystallization zone or in the non-crystallization zone.

(Direct Quenching or Accelerated Cooling)

After completing the hot-rolling, forced cooling is required in a temperature range from the $Ar_3$ transformation point or above to 400° C. to secure the strength of base material and the toughness of base material. The reason to cool the steel plate to 400° C. or lower temperature is to complete the transformation from austenite to martensite or bainite, thus strengthening the base material. The cooling rate is preferably 1° C./s or larger.

(Method for Installing the Tempering Apparatus)

The tempering is conducted by a heating apparatus that is installed in the same manufacturing line of the rolling mill and the direct quenching apparatus or the accelerated cooling apparatus, directly connecting thereto. The reason of the arrangement is that the direct connection thereto allows shortening of the time between the rolling and quenching treatment and the tempering treatment, thereby improving the productivity. FIG. 1 shows an example of the apparatuses arrangement according to the present invention.

(Tempering Condition—1)

During tempering, cementite is generated to some quantity by auto-tempering. (A material containing small amount of C gives high martensite transformation (Ms) temperature so that a part of supersaturated C forms cementite during cooling. The tempering phenomenon generated during cooling is called the "auto-tempering"). According to a study given by the inventors of the present invention, it was found that, when the quenched material in that state is tempered to 520° C. or higher temperature at an average temperature-rising rate of 1° C. Is or larger, preferably a high rate of 2° C. Is or larger, at the plate thickness center portion up to a specified tempering temperature between 460° C. and the $Ac_1$ transformation point, the cementite precipitates not only in prior austenite grain boundary and lath boundary but also within grains, thereby finely and dispersively precipitating the cementite. The phenomenon then suppresses the agglomeration and coarsening of cementite which is the main cause of deterioration in strength and toughness balance both before PWHT and after PWHT, which then improves the balance of strength and toughness both before PWHT and after PWHT more than the balance in conventional materials. Consequently, it was specified that the tempering is conducted so as the maximum ultimate temperature at the plate thickness center portion to become 520° C. or above applying the average temperature-rising rate of 1° C. Is or larger at the plate thickness center portion up to a specified tempering temperature between 460° C. and the $Ac_1$ transformation point.

(Tempering Condition—2)

The inventors of the present invention conducted detail study of the mechanism of finely dispersed precipitation of cementite under the above tempering condition 1, and found out that, when a quenched material which formed cementite to some quantity resulting from auto-tempering is heated, the cementite generated by the auto-tempering dissolves up to 460° C. of the steel plate temperature, and the nucleation and growth of cementite begins at the prior austenite grain boundary and the lath boundary at above 460° C. of the steel plate temperature, and the nucleation and growth of cementite begins inside the grains at above 520° C. of the steel plate temperature. Based on the finding, the following was experimentally verified. When the tempering is conducted at or above 520° C., by the regulation of average temperature-rising rate at the plate thickness center portion to a low level, or smaller than 1° C./s, between the tempering-start temperature and 460° C., a time for fully dissolving the cementite generated by the auto-tempering during quenching is secured. Furthermore, when the average temperature-rising rate at the plate thickness center portion is increased to 1° C./s or larger, preferably to a high level of 2° C./s or larger, up to a specified tempering temperature between 460° C. and the $Ac_1$ transformation point, and when the nucleation and growth of cementite at the prior austenite grain boundary and at the lath boundary are suppressed as far as possible to enhance the nucleation and growth of cementite inside the grains occurring at 520° C. or higher temperature, there is attained dispersed precipitation of further fine cementite than the case of tempering under the above-tempering condition 1, and the balance of strength and toughness after PWHT improves compared with the case of the above-tempering condition 1, (specifically, the tempering condition 2 gives better toughness both before PWHT and after PWHT than that of the tempering condition 1).

Based on the above findings, there have been specified that the average temperature-rising rate at the plate thickness center portion is smaller than 1° C./s between the tempering-start temperature and 460° C., that the average temperature-rising rate at the plate thickness center portion is 1° C./s or larger at a specified tempering temperature between 460° C. and the $Ac_1$ transformation point, and that the tempering is given to bring the maximum ultimate temperature at the plate thickness center portion to 520° C. or above.

The temperature of the steel plate according to the present invention is the temperature at the plate thickness center portion, which temperature is controlled by calculation using the observed temperatures on the steel plate surface applying radiation thermometer and the like.

Since the present invention is effective to all kinds of steels which are ingoted by converter process, electric furnace process, and the like, and also to all kinds of slabs which are manufactured by continuous casting process, ingoting process, and the like, there is no need of specifying the steel ingoting method and slab manufacturing method.

The heating method for tempering may be any kind of method that achieves desired temperature-rising rate, including induction heating, electric heating, infrared radiation heating, and atmosphere heating.

Specifying the average temperature-rising rate during tempering is given at the plate thickness center portion. Since, however, the zone near the plate thickness center portion has almost the same temperature history to that of the plate thickness center portion, the position for specifying the average temperature-rising rate is not necessarily restricted to the plate thickness center portion.

Since the present invention is effective if only the temperature-rising process during tempering assures the desired average temperature-rising rate, a linear temperature history or a temperature history of stagnating during the course of the tempering may be applicable. Consequently, the average temperature-rising rate is determined by dividing the temperature difference between the temperature of starting the temperature-rising and the temperature of ending the temperature-rising by the time consumed for the temperature-rising.

There is no need of holding at the tempering temperature. In case of holding at the tempering temperature, the holding time is preferably within 60 seconds to prevent increase in the manufacturing cost, to prevent decrease in the productivity, and to prevent deterioration of toughness caused by formation of coarse precipitates.

Regarding the cooling rate after tempering, it is preferable that the average temperature-rising rate at the plate thickness center portion is specified to 0.05° C./s or larger between the tempering temperature and 200° C. to prevent deterioration of toughness caused by the formation of coarse precipitates during cooling, or to prevent deterioration of toughness caused by insufficient tempering.

The temperature to change the temperature-rising rate is preferably 460° C. From the point of accuracy of apparatus, operational problems, and the like, however, the temperature to change the temperature-rising rate may be within a range from 420° C. to 500° C., or 460° C.±40° C., if only the average temperature-rising rate in a range from the cooling-start temperature to 460° C., and from 460° C. to the tempering temperature, satisfies the range specified by the present invention.

EXAMPLES

The present invention is described in more detail in the following referring to the examples.

Steels A to U, given in Table 1, were ingoted and cast to the respective slabs, which were then heated in a heating furnace, followed by rolling. After rolling, they were directly quenched. Then, using two units of solenoid induction heating apparatuses arranged in series, they were continuously tempered, applying the first induction heating apparatus in a temperature range from the tempering-start temperature to 460° C., and the second induction heating apparatus in a temperature range from 460° C. to the specified tempering temperature, (the temperature to change the temperature-rising rate was 460° C.). The average temperature-rising rate at the plate thickness center portion was controlled by the traveling speed of the steel plate. In the case that the tempering temperature was held, the holding temperature was regulated in a range of ±5° C. by letting the steel plate go and back for heating. The cooling after the heating was done by air-cooling.

To the above quenched and tempered materials, PWHT was applied under the condition of (580° C. to 690° C.)×(1 hr to 24 hr). The heating and cooling condition and the like were in accordance with JIS Z3700.

Table 1 shows the values of $P_{cm}$, $Ac_1$ transformation point, $Ac_3$ transformation point, and $Ar_3$ transformation point, while giving their calculation equations beneath the table.

Table 2 shows the above manufacturing conditions of steel plate, and Table 3 shows the tensile strength of the steel plate manufactured under the respective manufacturing conditions, and the brittleness and the ductile fracture surface transition temperature (vTrs) at the plate thickness center portion. The tensile strength was determined on a total thickness test piece. The toughness was evaluated by the fracture surface transition temperature vTrs which was determined by Charpy impact test on a test piece cut from the plate thickness center portion.

The target values of the material characteristics were: 570 MPa or larger tensile strength and −50° C. or below of vTrs, both before PWHT and after PWHT, for Steels A to F, M, and N; 780 MPa or larger tensile strength and −40° C. or below of vTrs, both before PWHT and after PWHT, for Steels G to L, and O to U; and 40 MPa or smaller difference in tensile strength between before PWHT and after PWHT, and 20° C. or smaller difference in vTrs between before PWHT and after PWHT for Steels A to U.

As seen in Table 3, Steel No. 1 to 20 (Examples of the invention) manufactured by the method according to the present invention satisfied the target values of: tensile strength and vTrs both before and after PWHT; and difference in tensile strength and in vTrs between before PWHT and after PWHT.

When Steel Nos. 9 and 10, (Examples of the invention), are compared, Steel No. 10 which was treated by smaller than 1° C./s of average temperature-rising rate at the plate thickness center portion between the tempering-start temperature and 460° C. improved the toughness both before PWTH and after PWHT more than that of Steel No. 9 which had the same composition to that of Steel No. 10, and which was treated by larger than 1° C./s of average temperature-rising rate at the plate thickness center portion between the tempering-start temperature and 460° C. Similarly, when Steel Nos. 11 and 12, (Examples of the present invention), are compared, Steel No. 12 improved the toughness both before PWHT and after PWHT more than that of Steel No. 11. If the tempering is given by smaller than 1° C./s of average temperature-rising rate at the plate thickness center portion between the tempering-start temperature and 460° C., it was confirmed that further fine cementite dispersed precipitates appeared, thus further improved the balance of tensile strength and toughness even after PWHT.

To the contrary, for Steel Nos. 21 to 35 which are Comparative Examples, at least two characteristics of the target values of the tensile strength both before PWHT and after PWHT, the vTrs both before and after PWHT, the difference in tensile strength between before PWHT and after PWHT, and the difference in vTrs between before PWHT and after PWHT were out of the above target range. The individual Comparative Examples are described in the following.

Steel Nos. 21, 22, and 23, which were out of the range of the present invention in terms of chemical components, failed to satisfy the target values at any two of the targets of: the tensile strength both before PWHT and after PWHT, the vTrs both before PWHT and after PWHT, the difference in tensile strength between before PWHT and after PWHT, and the difference in vTrs between before PWHT and after PWHT.

Steel No. 24 which was out of the range of the present invention in terms of slab heating temperature, (800° C., below the $Ac_3$ transformation point), failed to satisfy the all target values of the tensile strength both before PWHT and after PWHT, the vTrs both before PWHT and after PWHT, and the difference in vTrs between before PWHT and after PWHT.

Steel No. 25 which was out of the range of the present invention in terms of direct heating-start temperature, (730° C., below the $Ac_3$ transformation point), failed to satisfy the all target values of the tensile strength both before PWHT and after PWHT, the vTrs both before PWHT and after PWHT, and the difference in vTrs between before PWHT and after PWHT.

Steel No. 26 which was out of the range of the present invention in terms of direct heating-stop temperature, (450° C., above 400° C.), failed to satisfy the all target values of the tensile strength both before PWHT and after PWHT, the vTrs both before PWHT and after PWHT, and the difference in vTrs between before PWHT and after PWHT.

Steel Nos. 27, 28, 29, and 30, which were out of the range of the present invention in terms of average temperature-rising rate between the tempering-start temperature and 460° C., and of average temperature-rising rate between 460° C.

and the tempering temperature, failed to satisfy the all target values of the tensile strength after PWHT, the vTrs both before PWHT and after PWHT, the difference in tensile strength between before PWHT and after PWHT, and the difference in vTrs between before PWHT and after PWHT.

Steel Nos. 31, 32, 33, 34, and 35, which were out of the range of the present invention in terms of average temperature-rising rate between 460° C. and the tempering temperature, failed to satisfy the all target values of the vTrs both before PWHT and after PWHT, the difference in tensile strength between before PWHT and after PWHT, and the difference in vTrs between before PWHT and after PWHT.

INDUSTRIAL APPLICABILITY

The present invention allows manufacturing a high tensile strength steel plate having 570 MPa ($N/mm^2$) or larger tensile strength with extremely high balance of tensile strength and toughness both before PWHT and after PWHT. Therefore, the method for manufacturing high tensile strength steel plate of the present invention is applicable to not only the manufacture of high tensile strength steel plate treated by PWHT but also to the manufacture of high tensile strength steel plate without PWHT treatment.

TABLE 1

(mass %)

| Steel grade | C | Si | Mn | P | S | Cu | Ni | Cr | Mo | Nb | V | Ti |
|---|---|---|---|---|---|---|---|---|---|---|---|---|
| A | 0.08 | 0.20 | 1.31 | 0.011 | 0.001 | 0.00 | 0.00 | 0.00 | 0.05 | 0.012 | 0.000 | 0.000 |
| B | 0.15 | 0.34 | 1.35 | 0.018 | 0.002 | 0.00 | 0.00 | 0.00 | 0.00 | 0.000 | 0.000 | 0.000 |
| C | 0.09 | 0.26 | 1.45 | 0.014 | 0.002 | 0.00 | 0.00 | 0.00 | 0.00 | 0.021 | 0.041 | 0.008 |
| D | 0.09 | 0.29 | 0.92 | 0.014 | 0.008 | 0.18 | 0.09 | 0.16 | 0.14 | 0.000 | 0.082 | 0.000 |
| E | 0.11 | 0.33 | 1.22 | 0.012 | 0.005 | 0.38 | 0.19 | 0.35 | 0.00 | 0.000 | 0.000 | 0.000 |
| F | 0.06 | 0.47 | 0.62 | 0.011 | 0.001 | 0.15 | 0.45 | 1.45 | 0.52 | 0.000 | 0.000 | 0.005 |
| G | 0.15 | 0.34 | 1.22 | 0.018 | 0.004 | 0.00 | 0.00 | 0.06 | 0.05 | 0.022 | 0.008 | 0.009 |
| H | 0.14 | 0.33 | 1.20 | 0.014 | 0.005 | 0.00 | 0.00 | 0.09 | 0.14 | 0.022 | 0.020 | 0.013 |
| I | 0.08 | 0.26 | 0.93 | 0.007 | 0.008 | 0.21 | 1.21 | 0.53 | 0.33 | 0.010 | 0.050 | 0.000 |
| J | 0.09 | 0.21 | 1.09 | 0.005 | 0.002 | 0.17 | 1.52 | 0.28 | 0.48 | 0.012 | 0.050 | 0.000 |
| K | 0.09 | 0.27 | 0.77 | 0.002 | 0.001 | 0.00 | 3.07 | 0.51 | 0.50 | 0.000 | 0.112 | 0.000 |
| L | 0.09 | 0.18 | 1.45 | 0.009 | 0.003 | 0.19 | 2.25 | 0.42 | 0.48 | 0.010 | 0.042 | 0.000 |
| M | 0.02 | 0.42 | 1.50 | 0.029 | 0.028 | 0.30 | 0.32 | 0.19 | 0.25 | 0.020 | 0.041 | 0.011 |
| N | 0.09 | 0.18 | 1.34 | 0.009 | 0.001 | 0.00 | 0.00 | 0.11 | 0.21 | 0.022 | 0.000 | 0.018 |
| O | 0.12 | 0.41 | 1.48 | 0.013 | 0.002 | 0.00 | 0.00 | 0.53 | 0.38 | 0.019 | 0.045 | 0.011 |
| P | 0.18 | 0.42 | 1.12 | 0.005 | 0.001 | 0.26 | 0.27 | 0.33 | 0.64 | 0.018 | 0.042 | 0.010 |
| Q | 0.15 | 0.50 | 1.98 | 0.011 | 0.003 | 0.99 | 0.46 | 0.56 | 0.78 | 0.049 | 0.496 | 0.012 |
| R | 0.18 | 0.05 | 0.51 | 0.013 | 0.001 | 1.98 | 3.98 | 1.98 | 0.98 | 0.020 | 0.045 | 0.030 |
| S | 0.08 | 0.56 | 2.15 | 0.011 | 0.004 | 0.00 | 0.00 | 0.00 | 0.23 | 0.021 | 0.000 | 0.012 |
| T | 0.14 | 0.03 | 1.23 | 0.012 | 0.003 | 0.30 | 0.29 | 0.33 | 0.12 | 0.022 | 0.000 | 0.010 |
| U | 0.13 | 0.42 | 1.55 | 0.013 | 0.035 | 0.00 | 0.00 | 0.49 | 0.45 | 0.023 | 0.049 | 0.011 |

(mass %)

| Steel grade | B | Ca | Al | T.N | Pcm | Ac1 | Ac3 | Ar3 | Remark |
|---|---|---|---|---|---|---|---|---|---|
| A | 0.0000 | 0.0000 | 0.031 | 0.0025 | 0.16 | 709 | 830 | 776 | Inventive |
| B | 0.0000 | 0.0000 | 0.028 | 0.0029 | 0.23 | 712 | 823 | 756 | example |
| C | 0.0000 | 0.0000 | 0.022 | 0.0037 | 0.18 | 708 | 829 | 766 | |
| D | 0.0012 | 0.0000 | 0.030 | 0.0030 | 0.19 | 719 | 836 | 786 | |
| E | 0.0023 | 0.0000 | 0.027 | 0.0031 | 0.23 | 719 | 828 | 755 | |
| F | 0.0008 | 0.0000 | 0.025 | 0.0037 | 0.23 | 752 | 845 | 751 | |
| G | 0.0009 | 0.0000 | 0.024 | 0.0024 | 0.23 | 715 | 825 | 761 | |
| H | 0.0010 | 0.0000 | 0.032 | 0.0030 | 0.23 | 716 | 826 | 758 | |
| I | 0.0000 | 0.0000 | 0.033 | 0.0031 | 0.22 | 711 | 816 | 706 | |
| J | 0.0000 | 0.0000 | 0.028 | 0.0046 | 0.24 | 697 | 804 | 665 | |
| K | 0.0000 | 0.0000 | 0.052 | 0.0035 | 0.26 | 686 | 783 | 604 | |
| L | 0.0000 | 0.0000 | 0.027 | 0.0037 | 0.27 | 684 | 785 | 594 | |
| M | 0.0000 | 0.0000 | 0.035 | 0.0078 | 0.16 | 711 | 842 | 737 | |
| N | 0.0000 | 0.0000 | 0.030 | 0.0032 | 0.18 | 711 | 827 | 756 | |
| O | 0.0009 | 0.0000 | 0.033 | 0.0038 | 0.27 | 724 | 829 | 716 | |
| P | 0.0011 | 0.0000 | 0.028 | 0.0022 | 0.34 | 720 | 819 | 688 | |
| Q | 0.0013 | 0.0100 | 0.095 | 0.0029 | 0.46 | 713 | 812 | 589 | |
| R | 0.0030 | 0.0027 | 0.005 | 0.0005 | 0.56 | 706 | 742 | 447 | |
| S | 0.0000 | 0.0000 | 0.029 | 0.0037 | 0.22 | 705 | 834 | 695 | Comparative |
| T | 0.0000 | 0.0000 | 0.029 | 0.0041 | 0.25 | 710 | 807 | 732 | example |
| U | 0.0013 | 0.0000 | 0.003 | 0.0032 | 0.29 | 722 | 827 | 702 | |

Underlined values are outside the range of the invention.

Pcm = C + Si/30 + (Mn + Cu + Cr)/20 + Mo/15 + Ni/60 + V/10 + 5B

Ac1(° C.) = 723 − 14Mn + 22Si − 14.4Ni + 23.3Cr

Ac3(° C.) = 854 − 180C + 44Si − 14Mn − 17.8Ni − 1.7Cr

Ar3(° C.) = 910 − 310C − 80Mn − 20Cu − 15Cr − 55Ni − 80Mo

TABLE 2

(mass %)

| No. | Steel grade | Plate thickness (mm) | Slab-heating temp. (° C.) | Direct quenching-start temp. (° C.) | Direct quenching-stop temp. (° C.) | Tempering-start temp. (° C.) | Tempering temp. (° C.) | Average temp.-rising rate at the plate thickness center portion between the tempering-start temp. and 460° C. (° C./s) |
|---|---|---|---|---|---|---|---|---|
| 1 | A | 10 | 1150 | 830 | 170 | 140 | 550 | 0.9 |
| 2 | B | 25 | 1130 | 810 | 100 | 80 | 550 | 0.8 |
| 3 | C | 25 | 1130 | 850 | 180 | 150 | 600 | 0.1 |
| 4 | D | 25 | 1100 | 830 | 50 | 40 | 600 | 0.3 |
| 5 | E | 25 | 1050 | 820 | 170 | 140 | 600 | 0.5 |
| 6 | F | 25 | 1200 | 830 | 50 | 40 | 650 | 2.0 |
| 7 | G | 30 | 1100 | 850 | 130 | 100 | 680 | 0.7 |
| 8 | H | 40 | 1130 | 820 | 170 | 140 | 680 | 0.5 |
| 9 | I | 50 | 1150 | 830 | 380 | 350 | 650 | 5.5 |
| 10 | I | 50 | 1150 | 830 | 380 | 350 | 650 | 0.3 |
| 11 | J | 60 | 1130 | 850 | 100 | 80 | 550 | 4.0 |
| 12 | J | 60 | 1130 | 850 | 100 | 80 | 550 | 0.5 |
| 13 | K | 70 | 1100 | 820 | 300 | 270 | 650 | 0.6 |
| 14 | L | 100 | 1150 | 830 | 160 | 130 | 620 | 0.6 |
| 15 | M | 80 | 1120 | 850 | 330 | 300 | 600 | 0.5 |
| 16 | N | 25 | 1200 | 830 | 50 | 40 | 650 | 0.6 |
| 17 | O | 25 | 1100 | 850 | 140 | 110 | 640 | 0.3 |
| 18 | P | 10 | 1070 | 830 | 150 | 120 | 630 | 0.4 |
| 19 | Q | 8 | 1030 | 830 | 110 | 90 | 630 | 0.3 |
| 20 | R | 6 | 1050 | 780 | 70 | 60 | 620 | 0.2 |
| 21 | S | 12 | 1120 | 840 | 160 | 130 | 640 | 0.3 |
| 22 | T | 16 | 1140 | 850 | 110 | 90 | 550 | 0.5 |
| 23 | U | 20 | 1100 | 820 | 140 | 110 | 630 | 0.6 |
| 24 | A | 10 | 800 | 830 | 170 | 140 | 550 | 0.9 |
| 25 | B | 25 | 1130 | 730 | 100 | 80 | 550 | 0.8 |
| 26 | C | 25 | 1130 | 850 | 450 | 150 | 600 | 0.1 |
| 27 | D | 25 | 1100 | 830 | 50 | 40 | 600 | 1.1 |
| 28 | E | 25 | 1050 | 820 | 170 | 140 | 600 | 1.3 |
| 29 | F | 25 | 1200 | 830 | 50 | 40 | 650 | 2.0 |
| 30 | G | 30 | 1100 | 850 | 130 | 100 | 680 | 20.0 |
| 31 | H | 40 | 1130 | 820 | 170 | 140 | 680 | 0.5 |
| 32 | I | 50 | 1150 | 830 | 380 | 350 | 650 | 0.5 |
| 33 | J | 60 | 1130 | 850 | 100 | 80 | 550 | 0.5 |
| 34 | K | 70 | 1100 | 820 | 300 | 270 | 650 | 0.6 |
| 35 | L | 100 | 1150 | 830 | 160 | 130 | 620 | 0.6 |

(mass %)

| No. | Average temp.-rising rate the plate thickness center portion between 460° C. and the tempering temp. (° C./s) | Holding time until the tempering temp. (s) | Average cooling rate between the tempering temp. after holding and 200° C. (° C./s) | PWHT condition | Remark |
|---|---|---|---|---|---|
| 1 | 1.2 | 0 | 1 | 580° C. × 1 h | Example |
| 2 | 2.0 | 0 | 0.3 | 620° C. × 1 h | Example |
| 3 | 20.0 | 0 | 0.3 | 660° C. × 1 h | Example |
| 4 | 15.0 | 0 | 0.3 | 620° C. × 2 h | Example |
| 5 | 52.0 | 0 | 0.3 | 620° C. × 4 h | Example |
| 6 | 1.5 | 10 | 0.3 | 690° C. × 24 h | Example |
| 7 | 10.0 | 60 | 0.25 | 620° C. × 16 h | Example |
| 8 | 6.0 | 0 | 0.22 | 660° C. × 4 h | Example |
| 9 | 5.5 | 0 | 0.2 | 660° C. × 4 h | Example |
| 10 | 5.5 | 0 | 0.2 | 660° C. × 4 h | Example |
| 11 | 4.0 | 0 | 0.18 | 660° C. × 4 h | Example |
| 12 | 4.0 | 0 | 0.18 | 660° C. × 4 h | Example |
| 13 | 1.8 | 0 | 0.15 | 660° C. × 4 h | Example |
| 14 | 1.5 | 0 | 0.08 | 660° C. × 4 h | Example |
| 15 | 1.3 | 0 | 0.12 | 660° C. × 4 h | Example |
| 16 | 23.0 | 10 | 0.3 | 660° C. × 4 h | Example |
| 17 | 3.5 | 0 | 0.3 | 660° C. × 4 h | Example |
| 18 | 23.0 | 0 | 1 | 660° C. × 4 h | Example |
| 19 | 115.0 | 0 | 1.4 | 650° C. × 4 h | Example |
| 20 | 120.0 | 0 | 1.6 | 660° C. × 4 h | Example |
| 21 | 15.0 | 0 | 0.9 | 650° C. × 4 h | Comparative Example |
| 22 | 13.5 | 0 | 0.7 | 620° C. × 4 h | Comparative Example |

TABLE 2-continued

| | | | | | |
|---|---|---|---|---|---|
| 23 | 11.0 | 0 | 0.5 | 640° C. × 4 h | Comparative Example |
| 24 | 1.2 | 0 | 1 | 580° C. × 1 h | Comparative Example |
| 25 | 2.0 | 0 | 0.3 | 620° C. × 1 h | Comparative Example |
| 26 | 20.0 | 0 | 0.3 | 660° C. × 1 h | Comparative Example |
| 27 | 0.6 | 0 | 0.3 | 620° C. × 2 h | Comparative Example |
| 28 | 0.5 | 0 | 0.3 | 620° C. × 4 h | Comparative Example |
| 29 | 0.4 | 10 | 0.3 | 690° C. × 24 h | Comparative Example |
| 30 | 0.3 | 60 | 0.25 | 620° C. × 16 h | Comparative Example |
| 31 | 0.9 | 0 | 0.22 | 660° C. × 4 h | Comparative Example |
| 32 | 0.7 | 0 | 0.2 | 660° C. × 4 h | Comparative Example |
| 33 | 0.5 | 0 | 0.18 | 660° C. × 4 h | Comparative Example |
| 34 | 0.2 | 0 | 0.15 | 660° C. × 4 h | Comparative Example |
| 35 | 0.1 | 0 | 0.08 | 660° C. × 4 h | Comparative Example |

Underlined values are outside the range of the invention.

TABLE 3

| | | | before PWHT | | after PWHT | | Difference in the characteristics of [(After PWHT) − (Before PWHT)] | | |
|---|---|---|---|---|---|---|---|---|---|
| No. | Steel grade | Plate thickness (mm) | Tensile strength (MPa) | vTrs at the plate thickness center portion (° C.) | Tensile strength (MPa) | vTrs at the plate thickness center portion (° C.) | Tensile strength (MPa) | vTrs at the plate thickness center portion (° C.) | Remark |
| 1 | A | 10 | 641 | −110 | 650 | −107 | 9 | 3 | Example |
| 2 | B | 25 | 647 | −105 | 651 | −101 | 4 | 4 | Example |
| 3 | C | 25 | 615 | −83 | 610 | −80 | −5 | 3 | Example |
| 4 | D | 25 | 617 | −79 | 613 | −77 | −4 | 2 | Example |
| 5 | E | 25 | 610 | −87 | 605 | −84 | −5 | 3 | Example |
| 6 | F | 25 | 630 | −66 | 612 | −66 | −18 | 0 | Example |
| 7 | G | 30 | 841 | −90 | 820 | −82 | −21 | 8 | Example |
| 8 | H | 40 | 836 | −86 | 830 | −81 | −6 | 5 | Example |
| 9 | I | 50 | 824 | −65 | 821 | −62 | −3 | 3 | Example |
| 10 | I | 50 | 824 | −76 | 821 | −74 | −3 | 2 | Example |
| 11 | J | 60 | 992 | −61 | 970 | −59 | −22 | 2 | Example |
| 12 | J | 60 | 992 | −70 | 970 | −70 | −22 | 0 | Example |
| 13 | K | 70 | 997 | −65 | 965 | −63 | −32 | 2 | Example |
| 14 | L | 100 | 1011 | −60 | 992 | −59 | −19 | 1 | Example |
| 15 | M | 80 | 634 | −67 | 631 | −66 | −3 | 1 | Example |
| 16 | N | 25 | 624 | −85 | 611 | −82 | −13 | 3 | Example |
| 17 | O | 25 | 1151 | −77 | 1143 | −73 | −8 | 4 | Example |
| 18 | P | 10 | 1297 | −68 | 1289 | −66 | −8 | 2 | Example |
| 19 | Q | 8 | 1348 | −51 | 1341 | −48 | −7 | 3 | Example |
| 20 | R | 6 | 1567 | −52 | 1537 | −45 | −30 | 7 | Example |
| 21 | S | 12 | 963 | −26 | 951 | −20 | −12 | 6 | Comparative example |
| 22 | T | 16 | 980 | −67 | 967 | −35 | −13 | 32 | Comparative example |
| 23 | U | 20 | 1053 | −23 | 1037 | −18 | −16 | 5 | Comparative example |
| 24 | A | 10 | 514 | −45 | 520 | −22 | 6 | 23 | Comparative example |
| 25 | B | 25 | 530 | −40 | 540 | −18 | 10 | 22 | Comparative example |
| 26 | C | 25 | 552 | −35 | 520 | −9 | −32 | 26 | Comparative example |
| 27 | D | 25 | 610 | −32 | 554 | −11 | −56 | 21 | Comparative example |
| 28 | E | 25 | 605 | −41 | 523 | −18 | −82 | 23 | Comparative example |
| 29 | F | 25 | 620 | −24 | 560 | −1 | −60 | 23 | Comparative example |

TABLE 3-continued

| No. | Steel grade | Plate thickness (mm) | before PWHT Tensile strength (MPa) | before PWHT vTrs at the plate thickness center portion (° C.) | after PWHT Tensile strength (MPa) | after PWHT vTrs at the plate thickness center portion (° C.) | Difference in the characteristics of [(After PWHT) − (Before PWHT)] Tensile strength (MPa) | Difference in the characteristics of [(After PWHT) − (Before PWHT)] vTrs at the plate thickness center portion (° C.) | Remark |
|---|---|---|---|---|---|---|---|---|---|
| 30 | G | 30 | 847 | −29 | 768 | 0 | −79 | 29 | Comparative example |
| 31 | H | 40 | 840 | −23 | 782 | −1 | −58 | 22 | Comparative example |
| 32 | I | 50 | 850 | −33 | 790 | −2 | −60 | 31 | Comparative example |
| 33 | J | 60 | 990 | −32 | 917 | 5 | −73 | 37 | Comparative example |
| 34 | K | 70 | 1001 | −25 | 905 | 12 | −96 | 37 | Comparative example |
| 35 | L | 100 | 1015 | −17 | 911 | 10 | −104 | 27 | Comparative example |

Underlined values are outside the range of the invention.

The invention claimed is:

1. A method for manufacturing high tensile strength steel plate comprising the steps of: casting a steel consisting essentially of 0.02 to 0.18% C, 0.05 to 0.5% Si, 0.5 to 2.0% Mn, 0.005 to 0.1% Al, 0.0005 to 0.008% N, 0.03% or less P, 0.03% or less S, by mass, and balance of Fe and inevitable impurities; hot-rolling the cast steel without cooling the steel to the $Ar_3$ transformation point or lower temperature, or after reheating the steel to the $Ac_3$ transformation point or higher temperature, to a specified plate thickness; cooling the steel by direct quenching from the $Ar_3$ transformation point or higher temperature, or by accelerated cooling, to 400° C. or lower temperature; and then tempering the steel, using a heating apparatus being installed directly connecting the manufacturing line containing a rolling mill and a direct-quenching apparatus or an accelerated cooling apparatus, to 520° C. or above of the maximum ultimate temperature at the plate thickness center portion at an average temperature-rising rate of smaller than 1° C./s at the plate thickness center portion between the tempering-start temperature and 460° C., and at an average temperature-rising rate of 1° C./s or larger at the plate thickness center portion up to a specified tempering temperature between 460° C. and the $Ac_1$ transformation point.

2. The method for manufacturing high tensile strength steel plate according to claim 1, wherein the steel further contains one or more of 2% or less Cu, 4% or less Ni, 2% or less Cr, and 1% or less Mo, by mass.

3. The method for manufacturing high tensile strength steel plate according to claim 1, wherein the steel further contains one or more of 0.05% or less Nb, 0.5% or less V, and 0.03% or less Ti, by mass.

4. The method for manufacturing high tensile strength steel plate according to claim 2, wherein the steel further contains one or more of 0.05% or less Nb, 0.5% or less V, and 0.03% or less Ti, by mass.

5. The method for manufacturing high tensile strength steel plate according to claim 1, wherein the steel further contains one or more of 0.003% or less B, 0.01% or less Ca, 0.02% or less REM, and 0.01% or less Mg, by mass.

6. The method for manufacturing high tensile strength steel plate according to claim 2, wherein the steel further contains one or more of 0.003% or less B, 0.01% or less Ca, 0.02% or less REM, and 0.01% or less Mg, by mass.

7. The method for manufacturing high tensile strength steel plate according to claim 3, wherein the steel further contains one or more of 0.003% or less B, 0.01% or less Ca, 0.02% or less REM, and 0.01% or less Mg, by mass.

8. The method for manufacturing high tensile strength steel plate according to claim 4, wherein the steel further contains one or more of 0.003% or less B, 0.01% or less Ca, 0.02% or less REM, and 0.01% or less Mg, by mass.

* * * * *